US009094758B2

(12) United States Patent
Lee et al.

(10) Patent No.: US 9,094,758 B2
(45) Date of Patent: Jul. 28, 2015

(54) AUDIO TRANSMISSION LINE AND HEADSET

(75) Inventors: Yu-Lung Lee, New Taipei (TW); Po-Hua Hsu, New Taipei (TW)

(73) Assignee: POWERTECH INDUSTRIAL CO., LTD., New Taipei (TW)

( * ) Notice: Subject to any disclaimer, the term of this patent is extended or adjusted under 35 U.S.C. 154(b) by 625 days.

(21) Appl. No.: 13/471,187

(22) Filed: May 14, 2012

(65) Prior Publication Data

US 2013/0170663 A1 Jul. 4, 2013

(30) Foreign Application Priority Data

Dec. 30, 2011 (TW) ..... 100149788 A

(51) Int. Cl.
*H04R 1/10* (2006.01)
*H04R 3/00* (2006.01)

(52) U.S. Cl.
CPC ..... *H04R 1/1041* (2013.01); *H04R 3/00* (2013.01)

(58) Field of Classification Search
USPC ..... 381/74, 77, 80–81, 111, 122, 123, 309, 381/370; 439/668, 675, 669, 108, 339
See application file for complete search history.

(56) References Cited

U.S. PATENT DOCUMENTS 6,848,947 B2 * 2/2005 Chimiak ..... 439/638
6,979,231 B2 12/2005 Shinohara
7,618,294 B1 11/2009 Lin et al.
7,654,315 B2 2/2010 Du et al.
2002/0002061 A1 * 1/2002 Miyasaka et al. ..... 455/557
2004/0151330 A1 * 8/2004 Lehmkuhl ..... 381/123
2004/0213418 A1 * 10/2004 Chen ..... 381/77
2005/0064764 A1 3/2005 Shinohara
2006/0098828 A1 * 5/2006 Chu et al. ..... 381/110
2008/0137896 A1 * 6/2008 Tsen ..... 381/370
2008/0285776 A1 * 11/2008 Wu et al. ..... 381/114
2009/0277762 A1 * 11/2009 Nakatsuka et al. ..... 200/11 R
2010/0111321 A1 * 5/2010 Ku ..... 381/81
2010/0215183 A1 * 8/2010 Hansson et al. ..... 381/58
2013/0044892 A1 * 2/2013 Lafky et al. ..... 381/74

FOREIGN PATENT DOCUMENTS

CN 101232742 B * 10/2011
TW 200952276 A 12/2009
TW I324891 5/2010
TW 201143226 12/2011
WO WO 2006119625 A1 * 11/2006

* cited by examiner

*Primary Examiner* — Davetta W Goins
*Assistant Examiner* — Kuassi Ganmavo
(74) *Attorney, Agent, or Firm* — Li & Cai Intellectual Property (USA) Office

(57) ABSTRACT

An audio transmission line having an audio transmission plug and an inline controller and a headset is disclosed In the inline controller, one signal input end of signal input module is coupled to one signal transmission unit of the audio transmission plug. The first control part mechanically links up the first and second conductive part, for controlling the input end of first conductive part for connecting with several signal input ends of signal input module, and controlling the output end of the first conductive part for connecting with the input end of one wire circuit, or, controlling the input end of the second conductive part for connecting with the output end of the same wire circuit, and controlling the output end of the second conductive part for connecting with signal output ends of signal output module.

12 Claims, 12 Drawing Sheets

AUDIO TRANSMISSION LINE AND HEADSET

BACKGROUND OF THE INVENTION

1. Field of the Invention

The present invention relates to an audio transmission line and a headset; in particular, to an audio transmission line and a headset with capabilities of switching the transmission order of the input signals.

2. Description of Related Art

Generally, when the user wants to hear the audio sounds of an electrical device (such as a mobile phone, an MP3 player, or a PDA, etc.), besides using the speaker of the electrical device, he or she may connect the audio transmission plug of a headset to the headset socket of the electrical device, which allows the speaker of the headset to play the audio signals transmitted from the electrical device. Along with the improvement of the technology, the audio transmission plugs of the headset may be classified into two types: three-section type and four-section type, and each section may be a signal transmission unit. Presently, the headset socket of the electrical device usually has four signal coupling ends, for being corresponded to the four-section type audio transmission plug, which allows each signal transmission unit to carry different headset signals. In this case, the headset signals carried by the signal transmission units may be a left sound track signal, a right sound track signal, a microphone signal, and a ground signal.

Take the mobile phone as an example, although the size of the headset socket has its standard specification, the definitions of four signal coupling ends may be different among various of manufacturers. For example, part of the mobile phone manufacturers may be used to transmitting left sound track signals by using the first signal coupling end of the headset socket (which corresponds to the first signal transmission unit of the audio transmission plug of the headset), while other manufacturers uses the same headset socket for transmitting the microphone signals.

That is, the transmission order of headset signals may be various among different manufacturers. However, because the inner circuits of the conventional headset are fixed, if the first signal transmission unit is predetermined to connect with the left side speaker, apparently, the left side speaker can only correctly interpret left sound track signals, rather than microphone signals. On the other hand, if the first signal transmission unit is predetermined to connect with the microphone component which can only correctly interpret the microphone signals rather than left sound track signals.

In order to solve the problem of the difference of the transmission order, the R.O.C. invention patent I324891 discloses a headset which may read several kinds of headset signals, which its main content is shown in FIG. 1. As shown in FIG. 1, the headset device 9 in the patent I324891 has an audio transmission plug 90 and several sets of switches SW1 to SW4. The signal transmission unit 902 is correspondingly connected with switch SW1, similarly, the signal transmission units 904 to 908 are respectively connected with the switch SW2 to SW4 one-to-one. In addition, the audio transmission plug 90 may receive the left sound track signals, the right sound track signals, the microphone signals, and the ground signals from the mobile phone through the signal transmission units 902 to 908.

In this case, the patent I324891 claimed that due to the uncertainty of the order of left sound track signals, right sound track signals, microphone signals, and ground signals (which depend on the specifications of manufacturers), there may be sixteen types of modes of signal transmission of the headset device 9. Take switch SW1 for example, it may freely output the headset signals carried by the signal transmission unit 902 as left sound track signals LCH, right sound track signals RCH, microphone signals MIC, or ground signals GND, depending on which signals are accepted by the headset. That is, patent I324891 solves the problem of headset signal transmission order by allowing the four switched to output all of the left sound track signals LCH, the right sound track signals RCH, the microphone signals MIC, and the ground signals GND.

However, seeing from the aspects of practical using and manufacturing, implementing the sixteen switch types shown in patent I324891 (especially in FIG. 3), which makes the four switches output the four acceptable signals (LCH, RCH, MIC, and GND) respectively by only the mechanical and structural operations, is apparently impossible. We can know from line 11 of page 9 of the patent I324891 that it needs to install an extra control signal generator for generating control signals, and uses the control signals to shift the transmission modes the four switches. In other words, the patent I324891 actually uses an IC chip to control the four switches for selecting the sixteen transmission modes.

A person skilled in the art may know that it is hard for a user to select the correct signal transmission mode from the sixteen modes (especially when the user does not know what the differences between the several signal transmission orders are). In addition, if the headset need to include the IC chip, its manufacturing cost increases, and there may also need extra battery or power line for providing electric power to the IC chip, which makes the headset lack of competitiveness.

It's worth noting that, the R.O.C. disclosure No. 201143226 discloses a headset which claims to be able to implement the switch signal circuit by mechanical and structural operations. However, as shown in lines 11 to 14 of page 9 of the disclosure, it only discloses the techniques of switching the audio transmission plug between three-section type and four-section type, and does not solve the problem of signal transmission order. Moreover, because the structure shown in the disclosure is too simple, one skilled in the art cannot implement more complex switching by referring to both the patent I324891 and the disclosure 201143226.

Therefore, solving the aforementioned problem of the transmission order of the headset signals is still a goal to be achieved.

SUMMARY OF THE INVENTION

The object of the present invention is to provide an audio transmission line which is able to mechanically switch the connection relation between physical circuits, in order to make the headset signals of the audio transmission plug be received by the headset correctly. Therefore, without IC chip, the present invention may still solve the problem of the uncertainty of the transmission order of the headset signals defined by different manufacturers.

An embodiment of the present invention provides an audio transmission line which has an audio transmission plug and an inline controller. The audio transmission plug includes a plurality of signal transmission units for transmitting several headset signals of an electrical device. The inline controller is coupled to the audio transmission plug through a signal cable, and has a signal input module, a signal output module, a first control part, and several sets of wire circuits. The signal input module includes a plurality of signal input ends, and each of them is coupled to one of the signal transmission units one-to-one. The signal output module has several signal output ends. The first control part mechanically links up at least a first conductive part and a second conductive part. The input end of the first conductive part is coupled to the signal input ends, and the output end of the second conductive part is coupled to the signal output ends. There is a predetermined pin connection relationships between the input end and the output end of each set of the wire circuits, and the predetermined pin connection relationships of each of the wire circuits are different from one another. In addition, the first control part may selectively control the output end of the first conductive part for coupling to the input end of one of the wire circuits, or may control the input end of the second conductive part for coupling to the output end of the same wire circuit.

In an embodiment of the present invention, the inline controller has a first body and a second body. The first body is used for accommodating a first switch, and the second body may be rotatably connected with the first body. When the second body is rotated relative to the first body, the second body links up the first control part, for allowing the first control part to control the first conductive part and the second conductive part for being coupled to the same wire circuit.

In addition, an embodiment of the present invention also provides a headset which may be able to switch the electrical connection of the physical circuits, in order to make the headset signals of the audio transmission plug be received by the headset correctly. Therefore, without the IC chip, the present invention may still solve the problem of the uncertainty of the transmission order of the headset signals defined by different manufacturers.

An embodiment of the present invention discloses a headset having an audio transmission plug, an inline controller, and an audio output device. The audio transmission plug has several signal transmission units, for transmitting a plurality of headset signals of an electrical device. The inline controller is coupled to the audio transmission plug through a signal cable, and has a signal input module, a signal output module, a first control part, and a first switch. The signal input module has a plurality of signal input ends, and each of them is coupled to one of the signal transmission units one-to-one. The signal output module has several signal output ends. The first control part mechanically links up a first conductive part and a second conductive part. The input end of the first conductive part is coupled to the signal input ends, and the output end of the second conductive part is coupled to the signal output ends. The first switch has several sets of wire circuits, and there is a predetermined pin connection relationships between the input end and the output end of each wire circuit. The predetermined pin connection relationships of each of the wire circuits are different from one another. In addition, the first control part may selectively control the output end of the first conductive part for coupling to the input end of one of the wire circuits, and may control the input end of the second conductive part for coupling to the output end of the same wire circuit. The audio output device is coupled to the signal output module, for generating sounds according to the order of the headset signals outputted by the signal output ends.

On the basis of the above, the audio transmission line and headset in the present invention have multiple sets of wire circuits with different predetermined pin connection relationships. The user may mechanically switch the different wire circuits by operating the control part according to different specifications of the electrical devices, in order to allow the headset signals transmitted by the audio transmission plug to be received by the headset correctly. Therefore, without the IC chip, the present invention may still solve the problem of the uncertainty of the transmission order of the headset signals defined by different manufacturers.

For further understanding of the present disclosure, reference is made to the following detailed description illustrating the embodiments and examples of the present disclosure. The description is only for illustrating the present disclosure, not for limiting the scope of the claim.

BRIEF DESCRIPTION OF THE DRAWINGS

The drawings included herein provide further understanding of the present disclosure. A brief introduction of the drawings is as follows.

DETAILED DESCRIPTION OF THE PREFERRED EMBODIMENTS

The aforementioned illustrations and following detailed descriptions are exemplary for the purpose of further explaining the scope of the present invention. Other objectives and advantages related to the present invention will be illustrated in the subsequent descriptions and appended drawings.

[An Exemplary Embodiment of a Headset According to the Present Invention]

Figure 1:
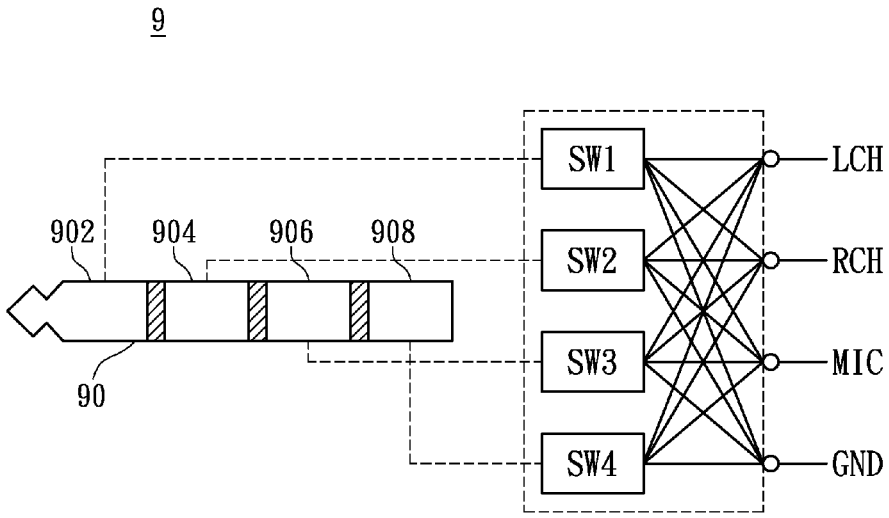
FIG. 1 PRIOR ART
FIG. 1 shows a function block diagram of the conventional headset.
Figure 2A:
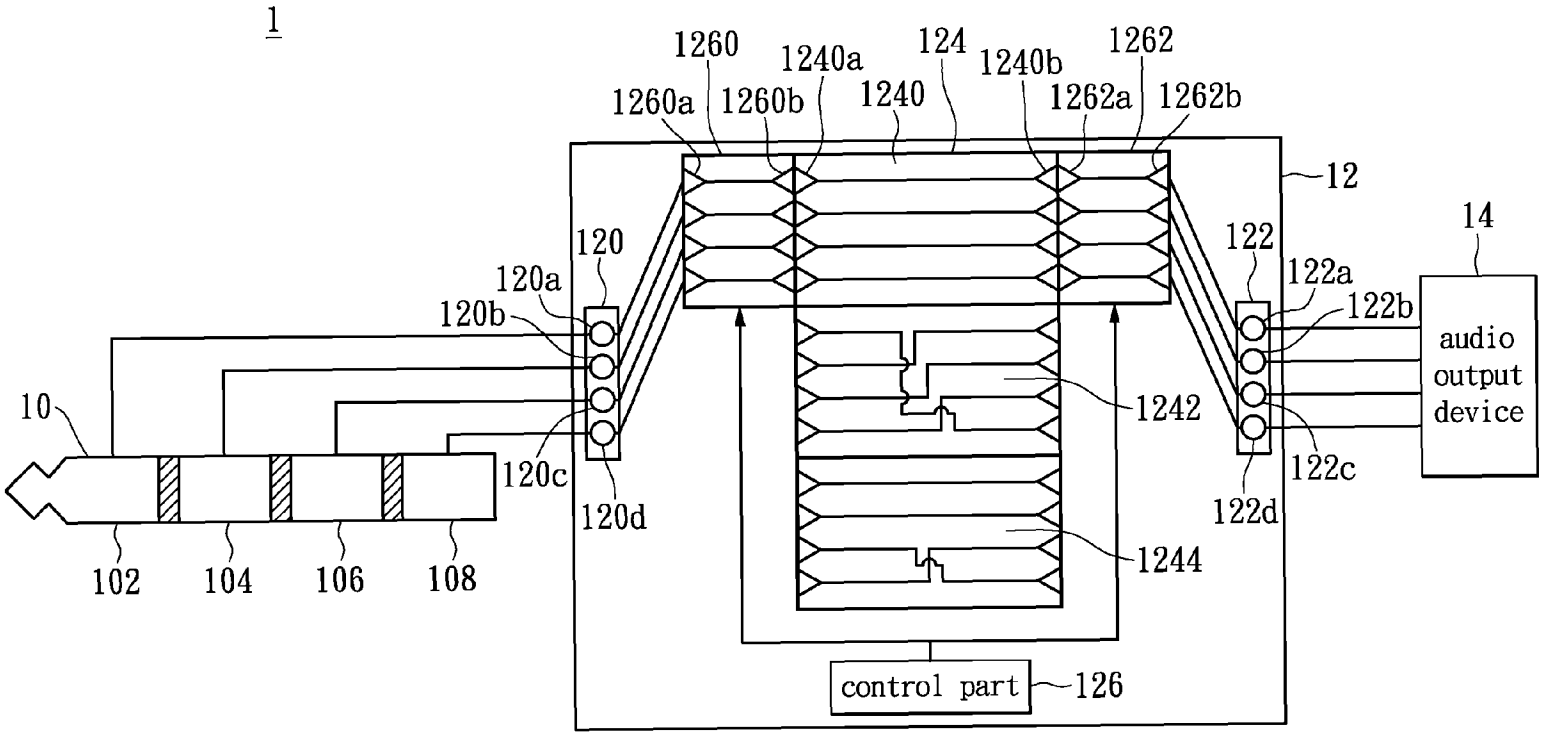
FIG. 2A shows a schematic circuit diagram of a headset coupled to a set of wire circuit according to an embodiment of the present invention.

Please refer to FIG. 2A. FIG. 2A shows a schematic circuit diagram of a headset coupled to one set of wire circuit according to an embodiment of the present invention. As shown in FIG. 2A, a headset 1 of the present invention has an audio transmission plug 10, an inline controller 12, and an audio output device 14. Practically, the audio transmission plug 10 is connected with the inline controller 12 through a signal cable (not shown in FIG. 2A), and the audio output device 14 may be a common speaker or microphone. In this case, the audio transmission plug 10 and the inline controller 12 may be seen as an audio transmission line, and the audio output device 14 may be fixed or pluggably connected to a signal output module of the audio transmission line. The following descriptions show the relations and functionalities of each component of the headset 1.

The audio transmission plug 10 has signal transmission units 102, 104, 106, and 108, for transmitting one type of headset signals respectively. Practically, the audio transmission plug 10 is plugged in an electrical device (not shown), and the headset signals include left sound track signals, right sound track signals, microphone signals, and ground signals. Because the electrical device does not fix the output order of the left sound track signals, the right sound track signals, the microphone signals, and the ground signals, the present invention does not restrict the type of headset signals carried by each of the signal transmission units (102 to 108). In addition, the present invention also does not restrict the size of the audio transmission plug 10. For example, the audio transmission plug 10 may be plugged in the 2.5 mm or 3.5 mm headset hole, which may be designed by one skilled in the art according to the actual requirements.

In this embodiment, the inline controller 12 has a signal input module 120, a signal output module 122, a switch 124, and a control part 126. the signal input module 120 has a plurality of signal input ends (120*a* to 120*d*), and each of the signal input ends is coupled to one of the signal transmission units (102 to 108) in one-to-one fashion. For explanation, this embodiment shows that the signal input end 120*a* is coupled to the signal transmission unit 102, the signal input end 120*b* is coupled to the signal transmission unit 104, the signal input end 120*c* is coupled to the signal transmission unit 106, and the signal input end 120*d* is coupled to the signal transmission unit 108. However, the connection described is not used for limiting the scope of the present invention. For example, the signal input end 120*a* may also be coupled to any other signal transmission units. Under the situation of one-to-one connection between the signal input end and the signal transmission unit, the one skilled in the art may change the connection between the signal input end and the signal transmission unit.

The signal output module 122 has several signal output ends (122*a* to 122*d*), for allowing the headset signals to be transmitted between the audio output device 14 and the inline controller 12. Practically, the audio output device 14 may have the corresponding left speaker transmission end, right speaker transmission end, ground end, and microphone transmission end. For example, the signal output end 122*a* may be pre-connected to the left speaker transmission end, the signal output end 122*b* may be pre-connected to the right speaker transmission end, the signal output end 122*c* may be pre-connected to the ground end, and the signal output end 122*d* may be pre-connected to the microphone transmission end. In other words, if the signal output end 122*a* receives the left sound track signals, the signal output end 122*b* receives the right sound track signals, the signal output end 122*c* receives the ground signals, and the signal output end 122*d* receives the microphone signals correctly, the audio output device 14 may work normally.

The switch 124 has several sets of wire circuits (1240 to 1244). There is a predetermined pin connection relationships between the input end and the output end of each set of wire circuits, and the predetermined pin connection relationships of different wire circuits are different from one another. In addition, the control part 126 mechanically links up the conductive parts 1260 and 1262. Thus, the control part 126 may selectively control the conductive parts 1260 and 1262 to respectively connect with two ends of one of the wire circuits (1240 to 1244). For example, FIG. 2A shows an embodiment that the user directly operates the control part 126 for respectively coupling the conductive parts 1260 and 1262 to the two ends of the wire circuit 1240.

Practically, the conductive part 1260 may have a set of input ends 1260*a* and a set of output ends 1260*b*. The input ends 1260*a* and the output ends 1260*b* may each have four independent conductive points, and the first to fourth conductive points of the input ends 1260*a* are respectively and electrically connected with the first to fourth conductive points of the output ends 1260*b*. In addition, the four conductive points of the input ends 1260*a* of the conductive part 1260 are respectively coupled to the signal input ends (120*a* to 120*d*), and the four conductive points of the output ends 1262*b* of the conductive part 1262 are respectively coupled to the signal output ends (122*a* to 122*d*). It is worth noting that the coupling relations between the conductive part 1260 and the signal input module 120, and between the conductive part 1262 and the signal output module 122 are fixed, and do not change when the control part 126 mechanically links up the conductive parts 1260 and 1262.

Back to FIG. 2A, when the conductive parts 1260 and 1262 are respectively coupled to the two ends of the wire circuit 1240, the output end 1260*b* of the conductive part 1260 connected with the input end 1240*a* of the wire circuit 1240. The input end 1240*a* of the wire circuit 1240 may also have four conductive points for respectively corresponding to the four conductive points of the output end 1260*b* of the conductive part 1260. Similarly, the output end 1240*b* of the wire circuit 1240 may also have four conductive points for respectively corresponding to the four conductive points of the input ends 1262*a* of the conductive part 1262. Thus, when the user knows the signal transmission unit 102 may receive the left sound track signals, he or she may choose to conduct the wire circuit 1240 by operating the control part 126, in order to allow the signal output ends 122*a* to receive the left sound track signals correctly, and make the audio output device 14 work normally.

Because the signal transmission pins of the signal output module 122 and the audio output device 14 is fixed (for example, the signal output ends 122*a* to 122*d* are respectively coupled to the left speaker transmission end, the right speaker transmission end, the ground end, and the microphone transmission end), the control part 126 is used for selecting a proper wire circuit 1240. The selected wire circuit 1240 arranges the headset signals received by the audio transmission plug 10, and switches the headset signals to the correct signal transmission path, which allows each signal output end (122*a* to 122*d*) of the signal output module 122 to receive the correct headset signals for sending to the audio output device 14. That is, when the control part 126 choose to conduct the wire circuit 1240, the signal input end 120*a* of the signal input module 120 may directly and electrically connect with the signal output end 122*a* of the signal output module 122 through the conductive part 1260, the wire circuit 1240, and the conductive part 1262. Thus, the headset 1 in this embodiment may directly transmit the left sound track signals carried by the signal transmission unit 102 of the audio transmission plug 10 to the left speaker transmission end of the audio output device 14. Of course, other kinds of headset signals may also be transmitted to the proper transmission ends of the audio output device 14 by using the similar manners.

Under a situation, if the electrical device is a mobile phone, and the manufacturer thereof is Apple, HTC, or Samsung, the first signal transmission unit 102 (the first section) of the audio transmission plug 10 is designed for transmitting the left sound track signals, the second signal transmission unit

104 (the second section) of the audio transmission plug 10 is designed for transmitting the right sound track signals, the third signal transmission unit 106 (the third section) of the audio transmission plug 10 is designed for transmitting the ground signals, and the fourth signal transmission unit 108 (the fourth section) of the audio transmission plug 10 is designed for transmitting the microphone signals. As shown in FIG. 2A, because a signal transmission path is set between the first conductive point of the input end 1240*a* and the first conductive point of the output end 1240*b*, the left sound track signals of the first signal transmission unit 102 of the audio transmission plug 10 may be directly transmitted to the left speaker transmission end of the audio output device 14. Similarly, because a signal transmission path is set between the second conductive point of the input end 1240*a* and the second conductive point of the output end 1240*b*, a signal transmission path is set between the third conductive point of the input end 1240*a* and the third conductive point of the output end 1240*b*, and a signal transmission path is also set between the fourth conductive point of the input end 1240*a* and the fourth conductive point of the output end 1240*b*, each kind of the headset signals may be transmitted to the audio output device 14 correctly.

However, under another situation, if the electrical device is the Blackberry mobile phone produced by RIM, the first signal transmission unit 102 (the first section) of the audio transmission plug 10 is designed for transmitting the microphone signals, the second signal transmission unit 104 (the second section) of the audio transmission plug 10 is designed for transmitting the left sound track signals, the third signal transmission unit 106 (the third section) of the audio transmission plug 10 is designed for transmitting the right sound track signals, and the fourth signal transmission unit 108 (the fourth section) of the audio transmission plug 10 is designed for transmitting the ground signals. Thus, the wire circuit 1240 shown in FIG. 2A may not be able to transmit each of the headset signals to the audio output device 14 correctly.

Therefore, the user may directly operate the control part 126 for coupling the conductive parts 1260 and 1262 to the two ends of another wire circuit (such as the wire circuit 1242), in order to make each of the signal output ends (122*a* to 122*d*) of the signal output module 122 acquire the correct headset signals and transmit to the audio output device 14.

It is worth noting that, although FIG. 2A shows that the conductive parts 1260 and 1262 are both able to be moved relative to the switch 124, the control part 126 may only control one of the conductive parts 1260 and 1262. For example, when the control part 126 only controls the conductive part 1260, the conductive part 1262 and the signal output module 122 may be combined together, which allows all of the output ends of the wire circuits (1240 to 1244) to be directly coupled to the signal output module 122. On the other hand, when the control part 126 only controls the conductive part 1262, the conductive part 1260 and the signal input module 120 may be combined, which allows all of the input ends of the wire circuits (1240 to 1244) to be directly coupled to the signal input module 120. By doing so, the present embodiment may also make the wire circuits (1240 to 1244) of the switch 124 be correspondingly switched by moving the conductive part 1260 or 1262.

Figure 2B:
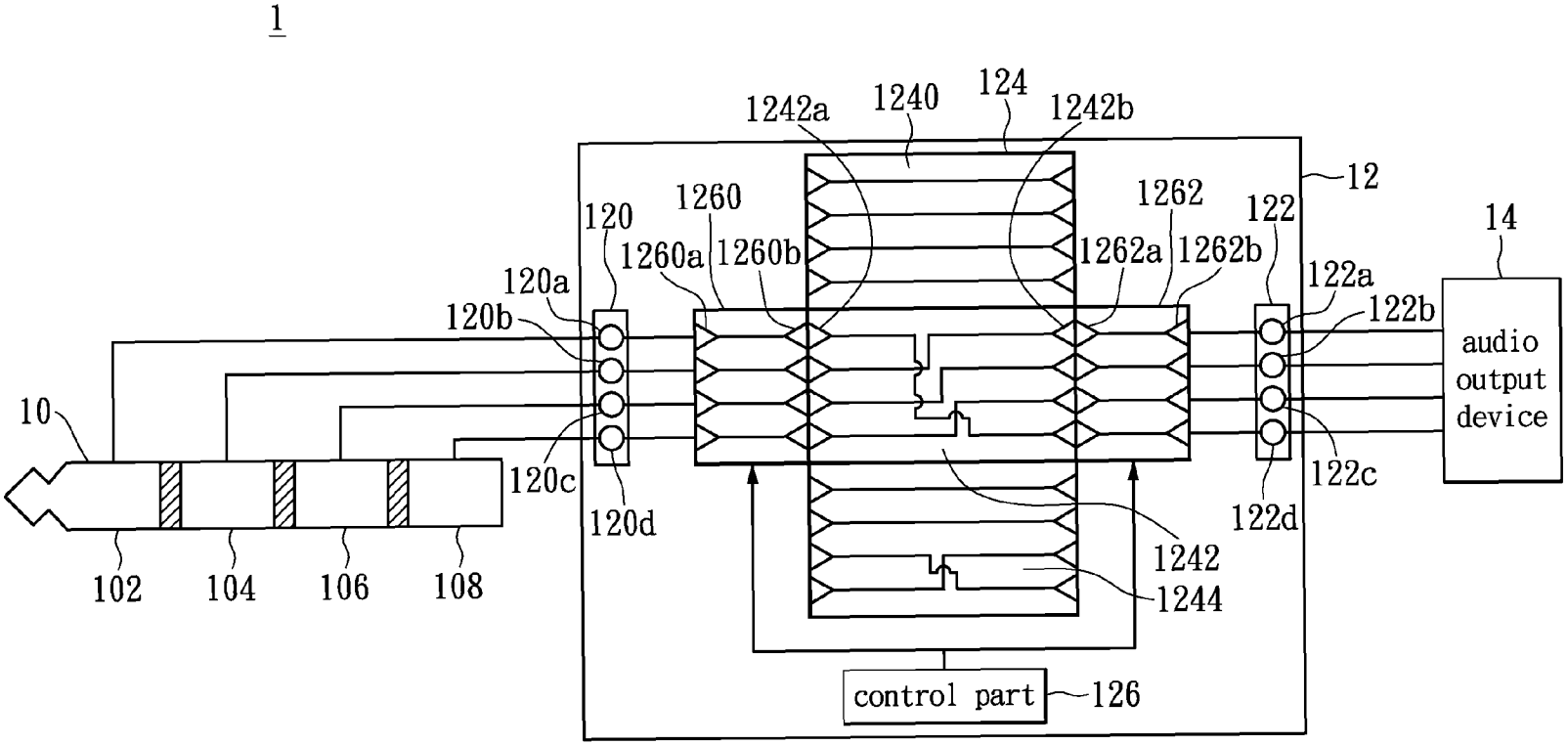
FIG. 2B shows a schematic circuit diagram of a headset coupled to another set of wire circuit according to an embodiment of the present invention.

Please refer to FIG. 2B which shows a circuit diagram of a headset coupled to another set of wire circuit according to an embodiment of the present invention. The differences between FIGS. 2A and 2B are that in FIG. 2B, the conductive parts 1260 and 1262 are coupled to the two ends of the wire circuit 1242. Particularly, the wire circuit 1242 shown in FIG. 2B has a signal transmission path between the first conductive point of the input end 1242*a* and the fourth conductive point of the output end 1242*b*, which makes the microphone signals of the first signal transmission unit 102 of the audio transmission plug 10 can be directly transmitted to the microphone transmission end of the audio output device 14. In addition, a signal transmission path is set between the second conductive point of the input end 1242*a* and the first conductive point of the output end 1242*b;* a signal transmission path is set between the third conductive point of the input end 1242*a* and the second conductive point of the output end 1242*b;* and a signal transmission path is set between the fourth conductive point of the input end 1242*a* and the third conductive point of the output end 1242*b*. Thus, all kinds of headset signals may be able to be transmitted to the audio output device 14 correctly.

Under another situation, if the electrical device is a mobile phone manufactured by Nokia, the first signal transmission unit 102 (the first section) of the audio transmission plug 10 is designed for transmitting the left sound track signals, the second signal transmission unit 104 (the second section) of the audio transmission plug 10 is designed for transmitting the right sound track signals, the third signal transmission unit 106 (the third section) of the audio transmission plug 10 is designed for transmitting the microphone track signals, and the fourth signal transmission unit 108 (the fourth section) of the audio transmission plug 10 is designed for transmitting the ground signals. In this embodiment, neither the wire circuit 1240 shown in FIG. 2A nor the wire circuit 1242 shown in FIG. 2B can correctly transmit all kinds of headset signals to the audio output device 14.

Therefore, the user may directly operate the control part 126 to respectively couple the conductive parts 1260 and 1262 to the two ends of another wire circuit (such as the wire circuit 1244), which makes each of the signal output ends (122*a* to 122*d*) of the signal output module 122 receive the correct headset signals for transmitting them to the audio output device 14.

Figure 2C:
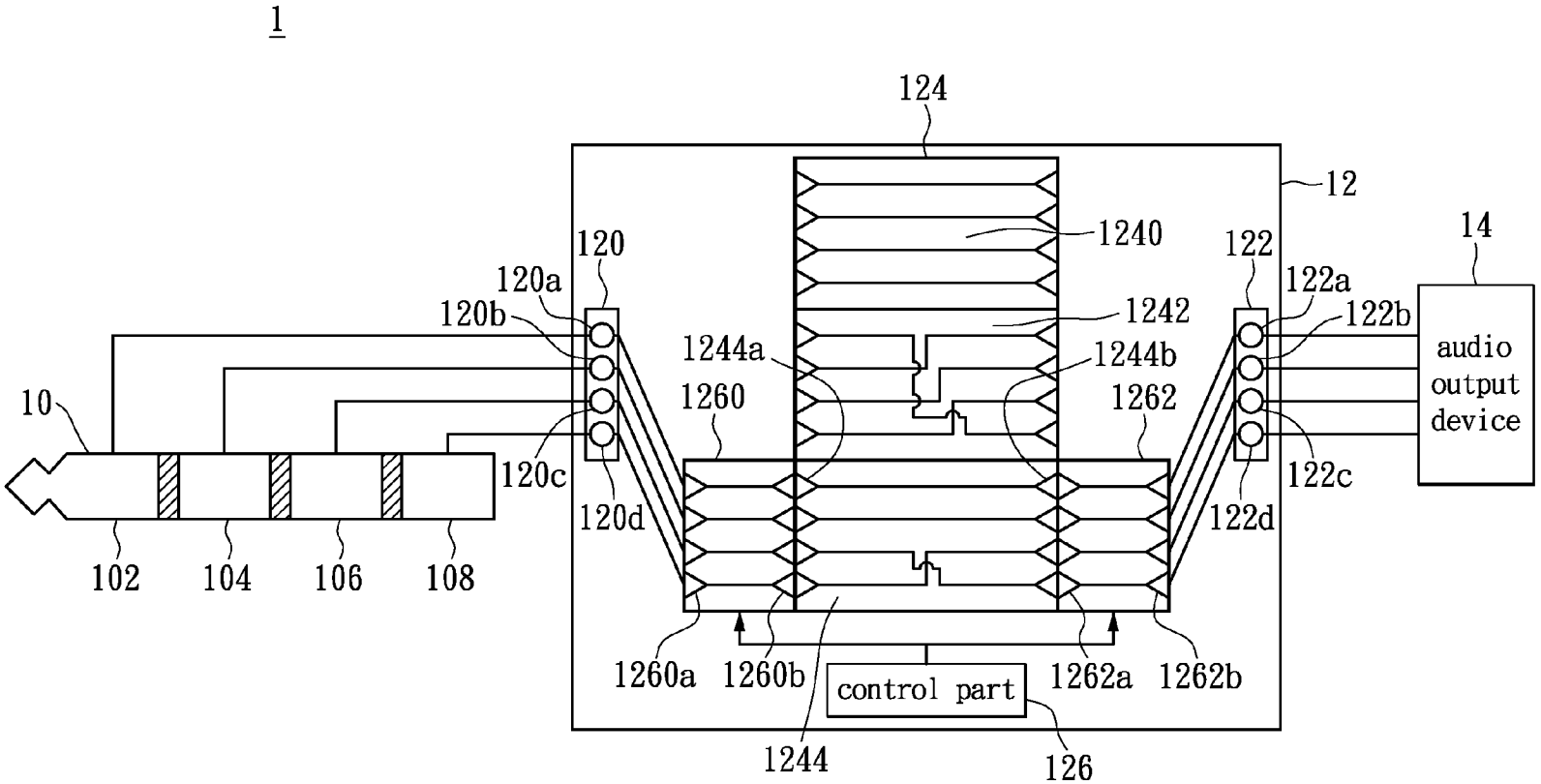
FIG. 2C shows a schematic circuit diagram of a headset coupled to still another set of wire circuit according to an embodiment of the present invention.

Please refer to FIG. 2C which shows a circuit diagram of a headset coupled to still another set of wire circuit according to an embodiment of the present invention. The differences between FIGS. 2A and 2C are that in FIG. 2C, the conductive parts 1260 and 1262 are coupled to the two ends of the wire circuit 1244. Particularly, the wire circuit 1244 shown in FIG. 2C has a signal transmission path between the first conductive point of the input end 1244*a* and the firth conductive point of the output end 1244*b*, which makes the left sound track signals of the first signal transmission unit 102 of the audio transmission plug 10 can be directly transmitted to the left speaker transmission end of the audio output device 14. In addition, a signal transmission path is set between the second conductive point of the input end 1244*a* and the second conductive point of the output end 1244*b;* a signal transmission path is set between the third conductive point of the input end 1244*a* and the fourth conductive point of the output end 1244*b;* and a signal transmission path is set between the fourth conductive point of the input end 1244*a* and the third conductive point of the output end 1244*b*. Thus, all kinds of headset signals may be able to be transmitted to the audio output device 14 correctly.

On the basis of the above, there are just a few differences between the wire circuits 1240 and 1244 which are respectively shown in FIGS. 2A and 2C. Particularly, there are just two signal transmission paths been changed. Therefore, the present invention discloses another implementation manner which implements the switching of the aforementioned three types of transmission methods by using a four-to-two switch (four input signals for switching between two modes) and a two-to-two switch (two input signals for switching between two modes).

[Another Exemplary Embodiment of a Headset According to the Present Invention]

Figure 3A:
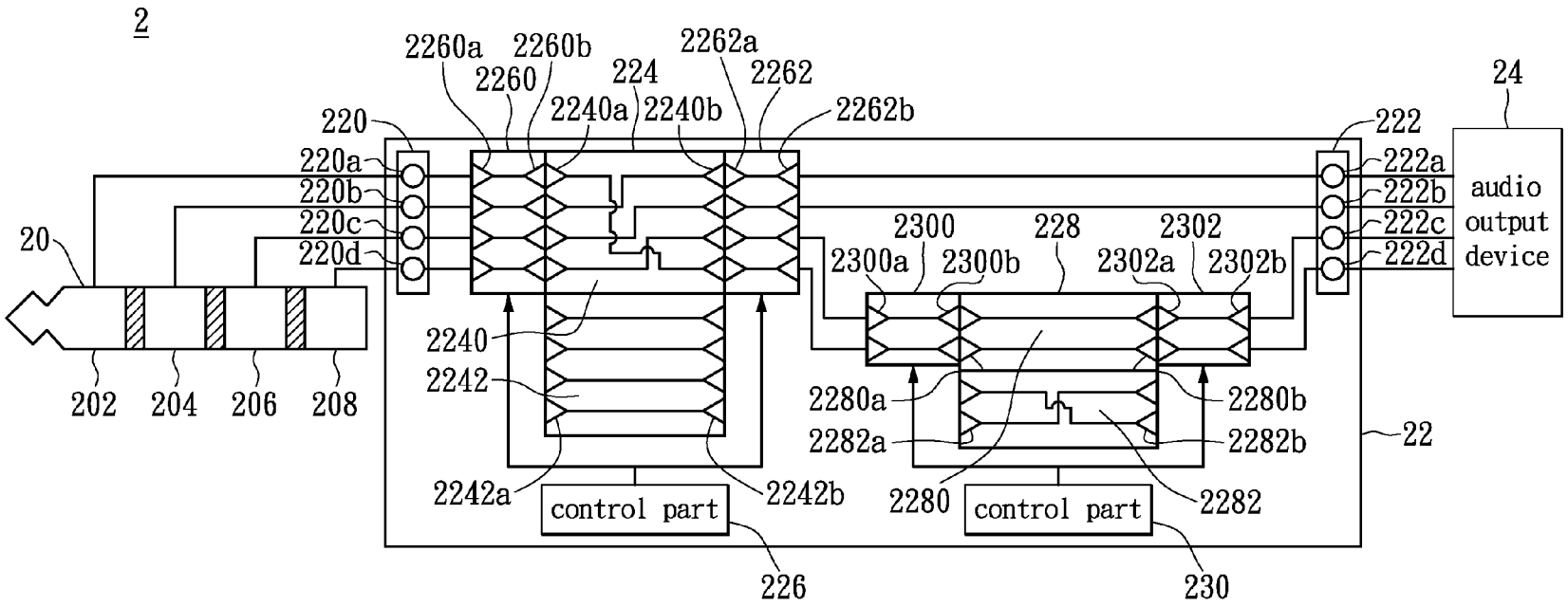
FIG. 3A shows a schematic circuit diagram of a headset coupled to a set of wire circuit and a set of auxiliary wire circuit according to an embodiment of the present invention.

Please refer to FIG. 3A which shows a circuit diagram of a headset coupled to a set of wire circuit and a set of auxiliary wire circuit according to another embodiment of the present invention. An audio transmission plug 20, an audio output device 24, a control part 226, a signal input module 220, and a signal output module 222 in this embodiment are similar to their counterparts in the aforementioned embodiment, thus they are not repeatedly described. The differences are that a switch 224 of an inline controller 22 in the present embodiment has only two sets of wire circuits (2240 and 2242), and a set of switch 228 and a control part 230 corresponding to the switch 228 are added. The wire circuits 2240 of switch 224 have the same pin relations as the wire circuits 1242, while the wire circuits 2242 of switch 224 have the same pin relation as the wire circuits 1240.

Particularly, the control part 230 mechanically links up the conductive parts 2300 and 2302. Thus, the control part 230 may selectively control the conductive parts 2300 and 2302 to be coupled to the two ends of one of the auxiliary wire circuits 2280 and 2282. In the auxiliary wire circuits 2280, a signal transmission path is set between the first conductive point of the input end 2280*a* and the first conductive point of the output end 2280*b*, and a signal transmission path is set between the second conductive point of the input end 2280*a* and the second conductive point of the output end 2280*b*. On the other hand, in the auxiliary wire circuits 2282, a signal transmission path is set between the first conductive point of the input end 2282*a* and the second conductive point of the output end 2282*b*, and a signal transmission path is set between the second conductive point of the input end 2282*a* and the first conductive point of the output end 2282*b*.

It is worth noting that, for the convenience of descriptions, the wire circuits 2240 are designed to be similar to the wire circuits 1242, and the wire circuits 2242 are designed to be similar to the wire circuits 1240. However, the actual pin relations of the wire circuits 2240 and 2242 are not restricted thereby. For example, the one skilled in the art may know that if the pin relations of the auxiliary wire circuits 2280 and 2282 are exchanged, the wire circuits 2242 may also be designed to be similar to the wire circuits 1244. In addition, in FIG. 3A, the conductive parts 2260 and 2262 are both movable relative to the switch 224, and the conductive parts 2300 and 2302 are both movable relative to the switch 228. However, the control part 226 may actually be able to control only one of the conductive parts 2260 and 2262, and the control part 230 may actually be able to control only one of the conductive parts 2300 and 2302.

In this case, FIG. 3A shows an example that the user directly controls the control part 226 for respectively coupling the conductive parts 2260 and 2262 to the two ends of the wire circuits 2240, and also controls the control part 230 for respectively coupling the conductive parts 2300 and 2302 to the two ends of the wire circuits 2242.

It is worth noting that in the present embodiment, the output end 2262*b* of the conductive part 2262 only has the former two conductive points are coupled to the signal output ends (222*a* to 222*b*), and the latter two conductive points of the output end 2262*b* of the conductive part 2262 are coupled to the two conductive points of the input end 2300*a* of the conductive part 2300. In addition, the two conductive points of the output end 2300*b* of the conductive part 2300 are respectively coupled to the signal output ends (222*c* to 222*d*).

Seeing from the aspect of actual operation, when the user uses the manner shown in FIG. 3A for controlling the control part 226 and control part 230 for respectively conducting the wire circuits 2240 and the auxiliary wire circuits 2280, the inline controller 22 may actually have the same functionalities as the inline controller 12 in FIG. 2B. That is, the headset 2 in FIG. 3A may be used for receiving the headset signals transmitted by the Blackberry mobile phone manufactured by RIM.

Figure 3B:
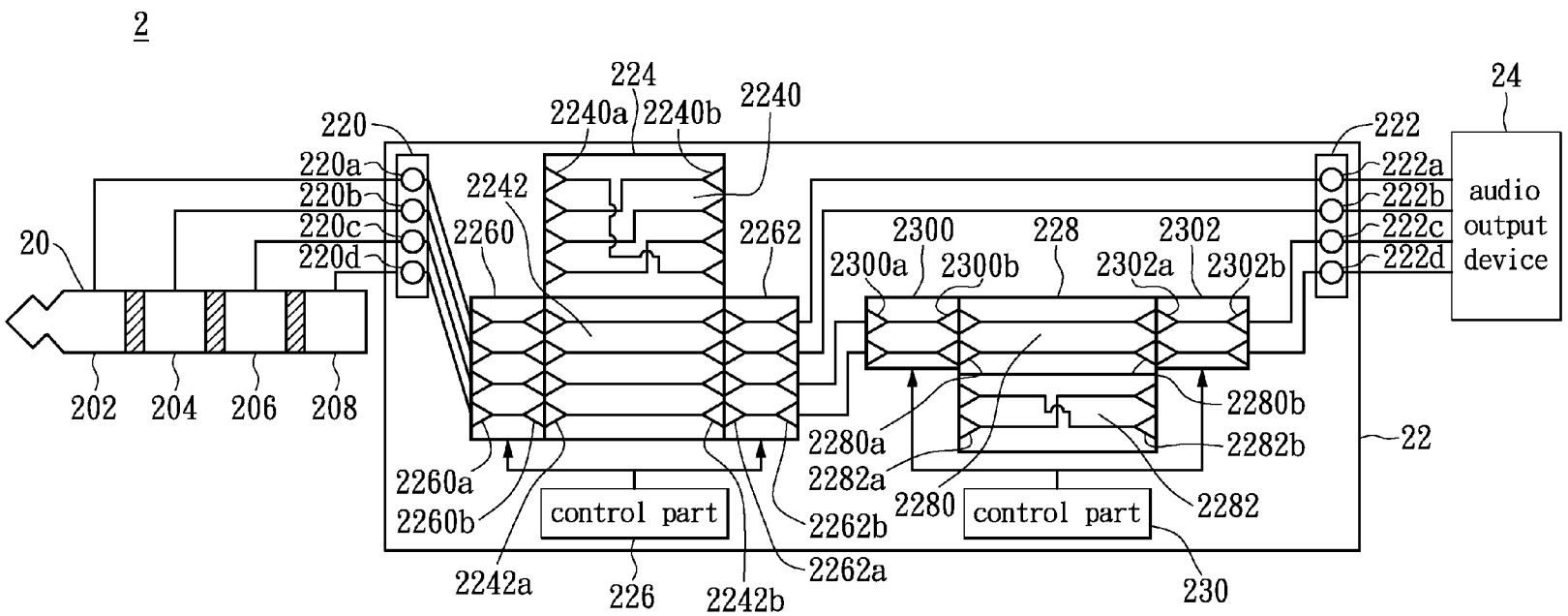
FIG. 3B shows a schematic circuit diagram of a headset coupled to another set of wire circuit and a set of auxiliary wire circuit according to an embodiment of the present invention.

Similarly, when the user uses the manner shown in FIG. 3B for controlling the control part 226 and the control part 230 for respectively conducting the wire circuits 2242 and the auxiliary wire circuits 2280, the inline controller 22 may actually have the same functionalities as the inline controller 12 in FIG. 2A. That is the headset 2 in FIG. 3B may be used for receiving the head set signals transmitted by the mobile phones manufactured by HTC or Apple.

Figure 3C:
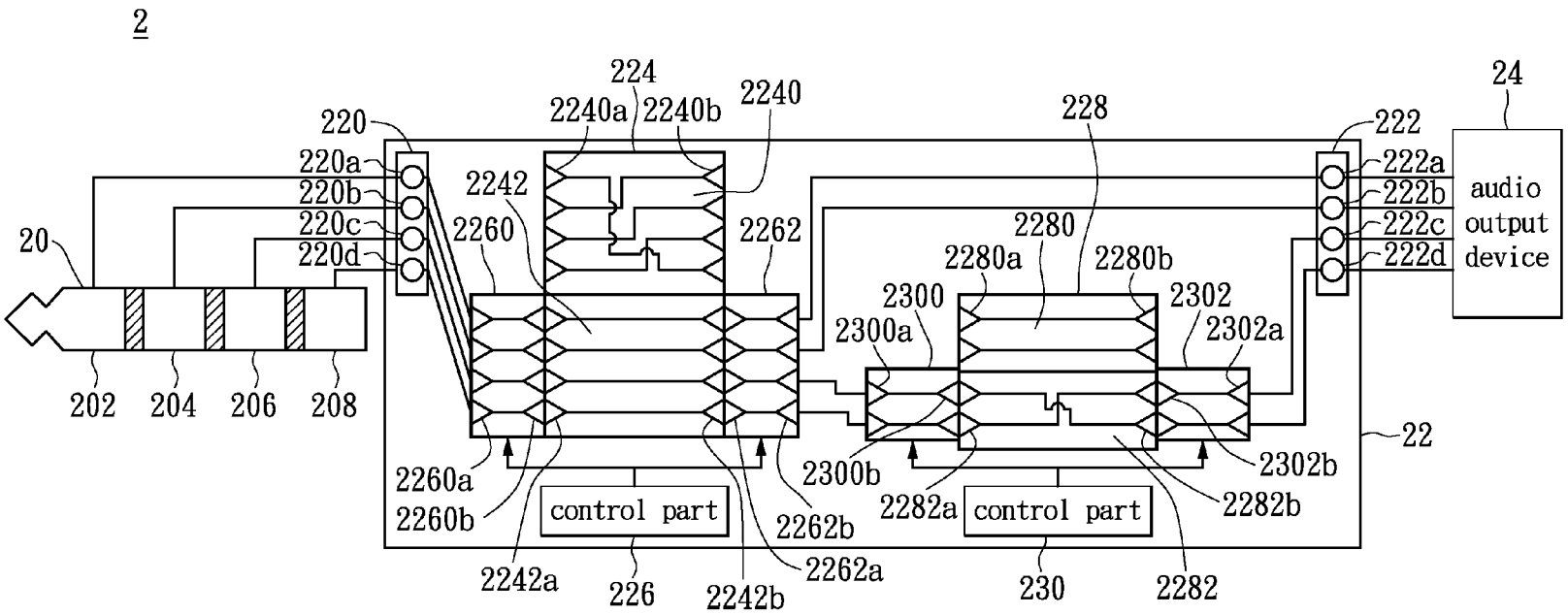
FIG. 3C shows a schematic circuit diagram of a headset coupled to another set of wire circuit and another set of auxiliary wire circuit according to an embodiment of the present invention.

On the other hand, when the user uses the manner shown in FIG. 3C for controlling the control part 226 and the control part 230 for respectively conducting the wire circuits 2242 and the auxiliary wire circuits 2282, the inline controller 22 may actually have the same functionalities as the inline controller 12 in FIG. 2C. That is the headset 2 in FIG. 3C may be used for receiving the head set signals transmitted by the mobile phones manufactured by Nokia.

Figure 4:
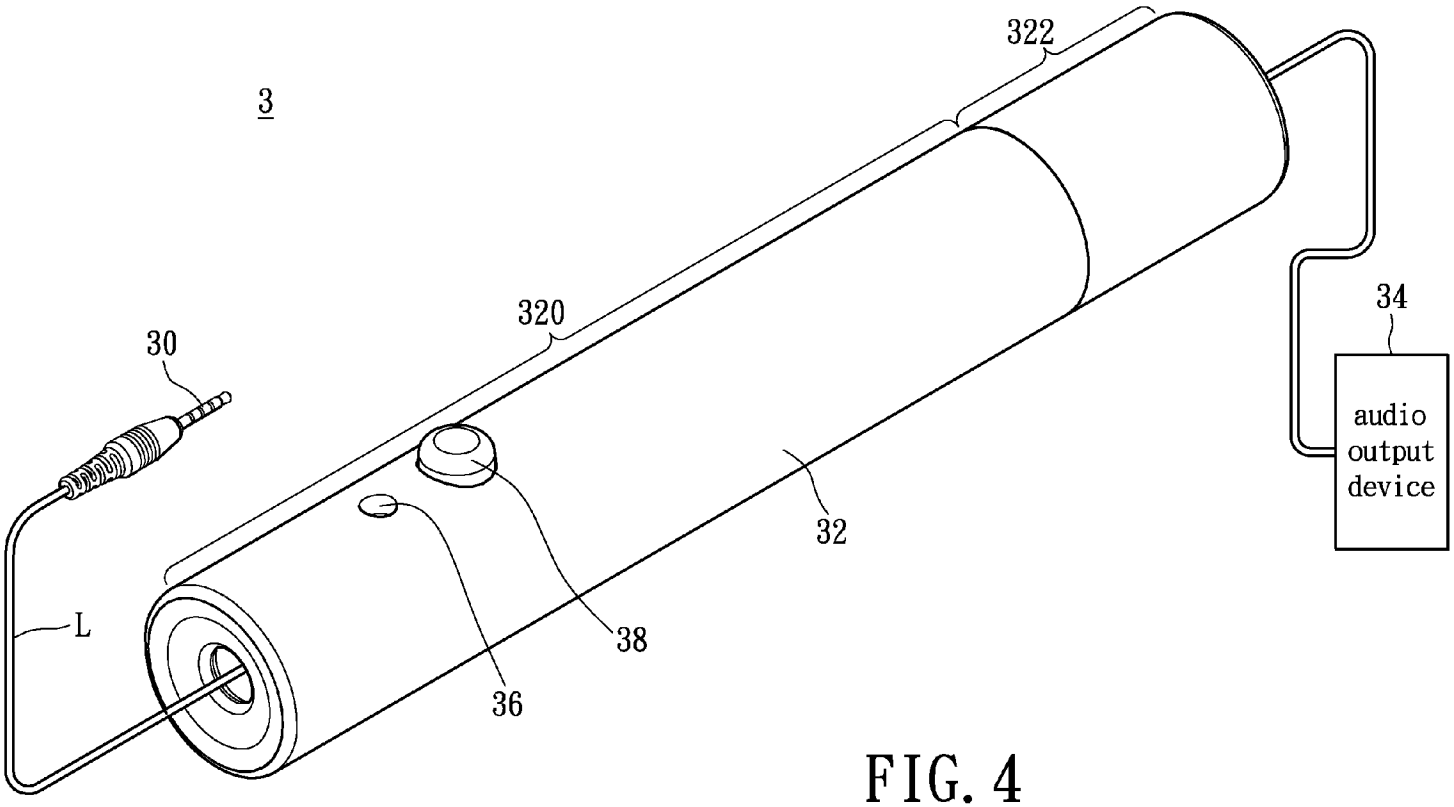
FIG. 4 shows a three dimensional view of the headset in FIG. 3A.

Seeing from the aspect of the appearances and structures of the headset, please refer to FIG. 4 which depicts a three dimensional diagram of the headset in FIG. 3A. As shown in FIG. 4, the headset 3 has an audio transmission plug 30, an inline controller 32, and an audio output device 34. The audio transmission plug 30 is the same as the audio transmission plug 20 in FIG. 3A and is not described repeatedly. The audio transmission plug 30, the inline controller 32, and the audio output device 34 in FIG. 4 are only for explaining the coupling relations thereof, and the relations of the audio transmission plug 30 and the audio output device 34 connecting to the inline controller 32 are not restricted thereby. For example, under the situation that the functionalities are not influenced, the connections of the audio transmission plug 30 and the audio output device 34 may also be exchanged with each other.

The inline controller 32 is coupled to the audio transmission plug 30 through a signal cable L, and has a first body 320 and a second body 322. The first body 320 is used for accommodating the components (including switches 224 and 228) of the inline controller 22 in FIG. 3A, and the second body 322 is rotatably connected with the first body 320. In practice, the appearances of the first body 320 and the second body 322 may both be pillar-shaped, for example, a cylinder. When the second body 322 is rotated relative to the first body 320, the second body 322 is rotated around the extension line of the long axis of the first body 320. In addition, when the second body 322 is rotated, it may link up one of the control parts 226 and 230 in FIG. 3A.

Thus, by linking up the control part 226, the conductive parts 2260 and 2262 may be coupled to one of the wire circuits 2240 or 2242 at the same time. By linking up the control part 230, the conductive parts 2300 and 2302 may be coupled to the auxiliary wire circuits 2280 or 2282.

Please refer to FIG. 4. The inline controller 32 of the headset 3 may further have a microphone 36 and a microphone switch 38. That is, the audio output device 34 may have only a speaker, and the signal output end 222*d* of the signal output module 222 in FIG. 3A may be coupled to the microphone 36, which makes the audio receiving and outputting functions be separated. Seeing from the aspect of actual using, only when the microphone switch 38 is pushed by the user, the microphone 36 of the headset 3 starts to receive sounds. The one skilled in the art may know the functionalities of the microphone 36 and the microphone switch 38, thus they are not described repeatedly in the following descriptions.

Figure 5:
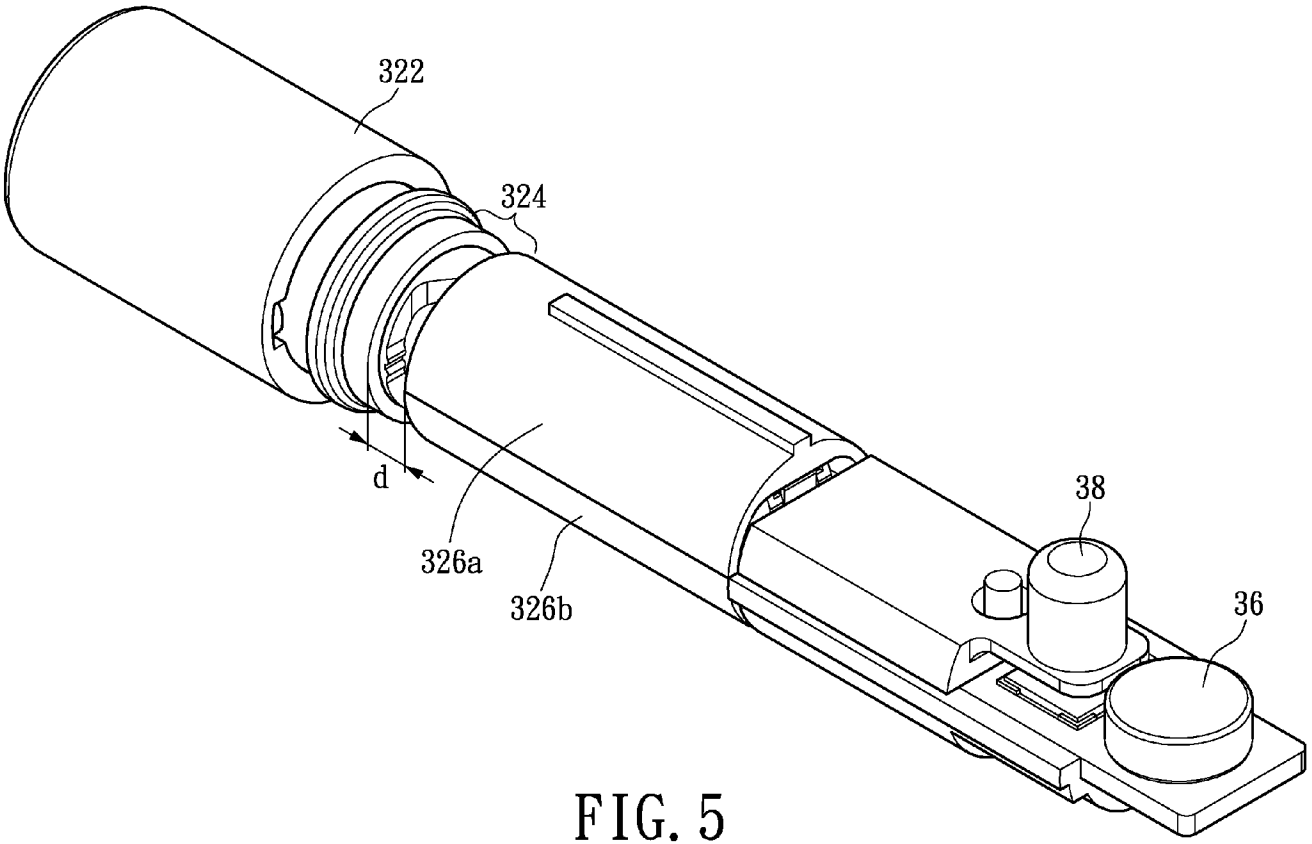
FIG. 5 shows an diagram of part of the inner structure of the headset in FIG. 4.

If the housing of the first body 320 is opened, we may refer to FIG. 5. As shown in FIG. 5, when the second body 322 is rotated, it may link up the first linkage part 324, which makes the first linkage part 324 be rotated in the same speed as the rotating second body 322. In addition, the second linkage part 326*a* may be linked by the first linkage part 324 and be moved by a displacement d which is parallel to the long axis of the first body 320. Certainly, there may have a correlation between the rotation angle of the second body 322 and the magnitude of the displacement d. For example, when the second body 322 is rotated by 90 degrees, the second linkage part 326*a* may move toward the second body 322 by a displacement d, and then when the second body 322 is rotated by 90 degrees again (totally 180 degrees), the second linkage part 326*a* may move toward the opposite way by the displacement d (back to the original place). In this case, the present embodiment does not restrict the magnitudes of the rotation angle and the displacement d, and they may be set by one skilled in the art according to actual requirements.

Figure 6:
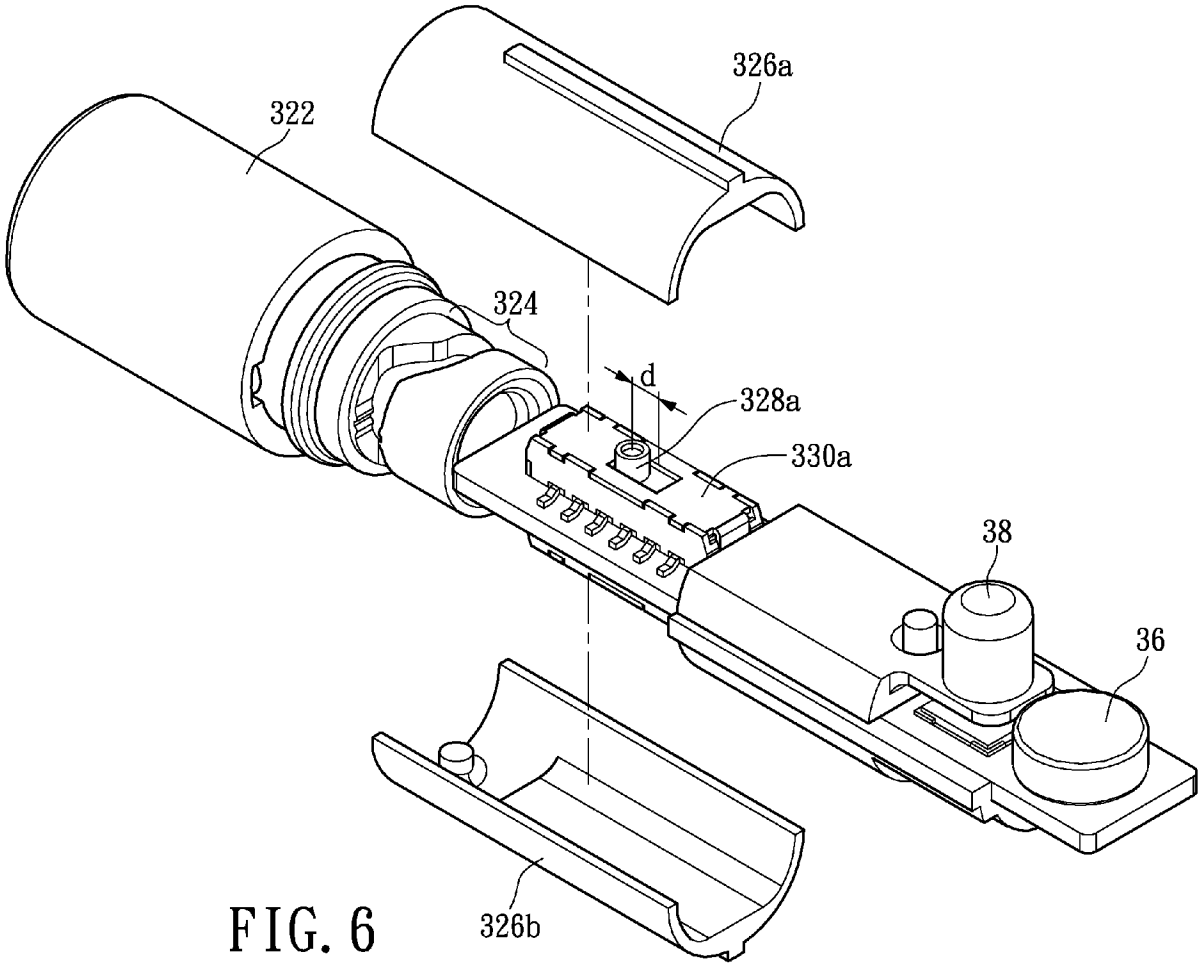
FIG. 6 shows an diagram of part of the inner structure of the headset in FIG. 5.

As shown in FIG. 6, the second linkage part 326*a* may actually be used for controlling the third linkage part 328*a* of the switch 330*a*. When seeing the switch 330*a* as the switch 224 in the FIG. 3A, the third linkage part 328*a* may be used for linking up the conductive parts 2260 and 2262. In other words, the combination of the second body 322, the first linkage part 324, the second linkage part 326*a*, and the third linkage part 328*a* may serve as the control part 226 in FIG. 3A, and the user may switch the switch 224 by rotating the second body 322. The displacement d may be the actual distance that the conductive parts 2260 and 2262 changing from the wire circuits 2240 to 2242. If there are three wire circuits as shown in FIG. 2A, the distance between two of the wire circuits may be half of the displacement d, which makes displacements 0, 0.5d, and d be corresponded to the three wire circuits.

As shown in FIG. 3A, the present invention may have not only one set of switch 330*a*, but also another set of switch 330*b* (in FIG. 7, it may be corresponded to the switch 228 in FIG. 3A) which is similar to the switch 330*a*. Please refer to FIG. 7. Seeing from the side view of the headset 3, if only the set of switch 330*a* (and the second linkage part 326*a* and the third linkage part 328*a* linked up with the switch 330*a*), another set of switch 330*b* (and the second linkage part 326*b* and the third linkage part 328*b* linked up with the switch 330*b*), and the substrate 38 used for disposing the switches 330*a* and 330*b* are kept, the relations between the switches 330*a* and 330*b* may be seen.

Figure 7:
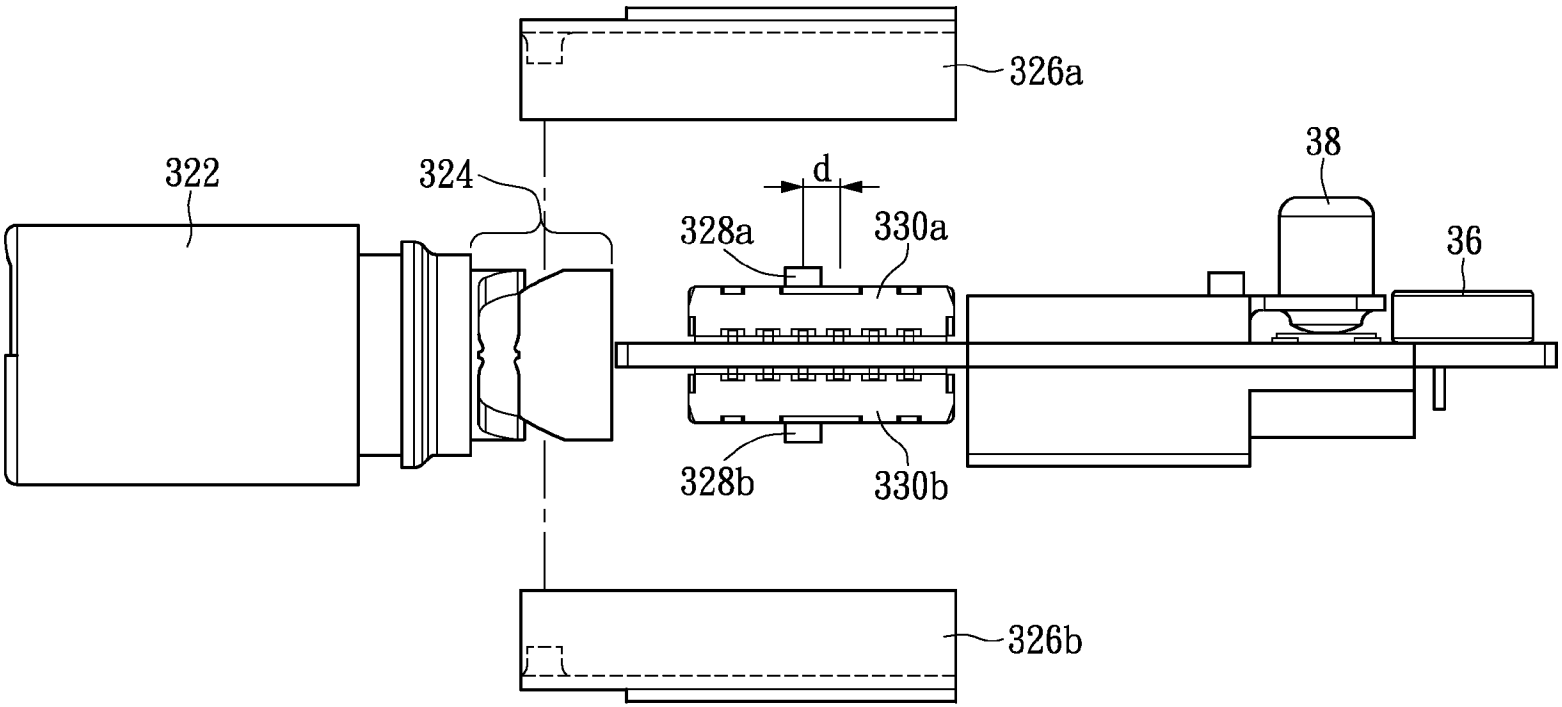
FIG. 7 shows an diagram of part of the inner structure of the headset in FIG. 6.

Please refer to FIGS. 6 and 7. Seeing from the aspect of actual operation, the first linkage part 324 may be properly designed for selectively linking up the second linkage parts 326*a* or 326*b*, or both. For example, when the user rotates the second body 322 by 90 degrees clockwise, the second linkage part 326*a* may be linked up through the first linkage part 324, and when the user rotates the second body by 90 degrees counterclockwise, the second linkage part 326*b* may be linked through the first linkage part 324. The user may be able to rotate the second body 322 according to the manufacturer of the mobile phone, for making all of the headset signals of the audio transmission plug 30 be transmitted and received correctly between the audio output device 34 (or microphone 36) and the mobile phone.

Although the aforementioned embodiment uses the operation of rotating the second body 322 for linking up the third linkage part 328*a* to move, the implementation is not limited thereby. For example, the second body 322, the first linkage part 324, and the second linkage part 326*b* may all be ignored, as long as the third linkage part 328*a* is exposed out of the housing of the first body 320 and can be operated directly by the user. In other words, when the user is using the headset 3, he or she may operate the third linkage 328*a* in a linear direction and makes the third linkage part 328*a* move by a displacement d, rather than rotates the second body 322, for achieving the purpose of switching the wire circuits in the switch 330*a*. Although the present embodiment uses rotation and linear operations as examples, the one skilled in the art may know that the user may use moving, sliding, pushing, or other proper operations for controlling the components of the inline controller 32, which allows the components to make the third linkage part 328*a* to move by a displacement d. That is, the scope of the present invention is not restricted thereby.

Figure 8B:
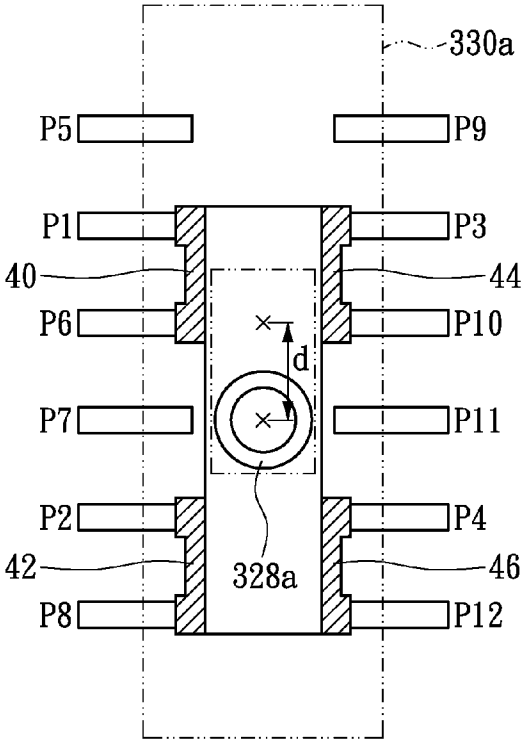
FIG. 8B shows another schematic structural diagram of a third linkage part and a switch according to an embodiment of the present invention.
Figure 8A:
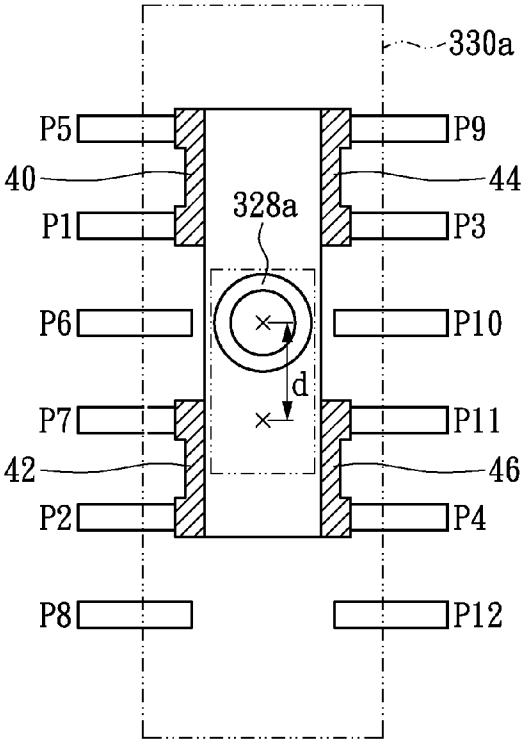
FIG. 8A shows a schematic structural diagram of a third linkage part and a switch according to an embodiment of the present invention.

In the light of the operation manners of the third linkage part 328*a* and the switch 330*a*, please refer to FIGS. 8A and 8B together. FIG. 8A shows a schematic structure diagram of the third linkage part and the switch according to an embodiment of the present invention, and FIG. 8B shows another schematic structure diagram of the third linkage part and the switch according to an embodiment of the present invention. As shown in the figures, if the switch 330*a* is separated into several parts, we may see that the third linkage part 328*a* can simultaneously link up four metal chunks (40, 42, 44, and 46), and the four metal chunks may serve as the conductive part 2260 (or 2262) in FIG. 3A. The switch 330*a* may have twelve conductive pins (P1 to P12). The conductive pins (P1 to P4) may respectively connect with the signal output ends (220*a* to 220*d*) of the signal input module 220 of FIG. 3A, for receiving the headset signals transmitted from the audio transmission plug 30. On the other hand, the conductive pins P5, P7, P9, and P11 may respectively connect with the input end 2240*a* of the wire circuits 2240 in the FIG. 3A, and the conductive pins P6, P8, P10, and P12 may respectively connect to the input ends 2242*a* of the wire circuits 2242 in FIG. 3A.

When the third linkage part 328*a* is at the position shown in FIG. 8A, the conductive pins P1 to P4 may respectively be coupled to the conductive pins P5, P7, P9, and P11 through the metal chunks 40, 42, 44, and 46, and when the third linkage part 328*a* is at the position shown in FIG. 8B, the conductive pins P1 to P4 may be respectively coupled to the conductive pins P6, P8, P10, and P12 through the metal chunks 40, 42, 44, and 46. By doing this, the structures shown in FIGS. 8A and 8B may be used as examples for implementing the conductive part 2260 in FIG. 3A for switching the wire circuits 2240 and 2242. As long as the conductive pins are connected to the proper input ends or output ends, the other conductive parts in the present invention may switch the corresponding wire circuits by using similar manners as in FIGS. 8A and 8B, and implementations of the manners are not restricted by the present invention.

Because the second body 322 of the inline controller 32 in FIG. 4 may be able to be mechanically rotated, thus each of the linkage parts may carry considerable forces. The second body 322 is not suitable to be integrated with the audio transmission plug 30. Because the audio transmission plug 30 needs to be pulled and plugged frequently, if the inline controller 32 is integrated with the audio transmission plug 30, the mechanical components may be damaged quickly. There may need a signal cable L between the audio transmission plug 30 and the inline controller 32, for reducing the forces transmitted to the inline controller 32 when pulling or plugging the audio transmission plug 30.

On the basis of the above, the audio transmission lines and the headsets disclosed by the embodiments of the present invention have several sets of wire circuits, and each of them has different predetermined pin connection relationships. The user may mechanically switch different wire circuits through control parts according to different standards and specifications of the electrical devices, for making the headset signals transmitted by the audio transmission plug be received by the headset correctly. Without using the IC chip, the present invention may be able to solve the aforementioned problem of the transmission orders.

Some modifications of these examples, as well as other possibilities will, on reading or having read this description, or having comprehended these examples, will occur to those skilled in the art. Such modifications and variations are comprehended within this disclosure as described here and claimed below. The description above illustrates only a relative few specific embodiments and examples of the present disclosure. The present disclosure, indeed, does include various modifications and variations made to the structures and operations described herein, which still fall within the scope of the present disclosure as defined in the following claims

What is claimed is:

1. An audio transmission line, comprising:

an audio transmission plug for being coupled to an electrical device, and having a plurality of signal transmission units for transmitting a plurality of headset signals, each of the signal transmission units transmitting one of the headset signals; and an inline controller coupled to the audio transmission plug through a signal cable, including:

a signal input module having a plurality of signal input ends, each of the signal input ends being coupled to one of the signal transmission units in an one-to-one fashion;

a signal output module having a plurality of signal output ends;

a first control part mechanically linking up at least one first conductive part or one second conductive part, input ends of the first conductive part being coupled to the signal input ends, and output ends of the second conductive part being coupled to the signal output ends; and a plurality of wire circuits, a predetermined pin connection relationship being provided between input ends and output ends of each of the wire circuits, and the predetermined pin connection relationships of different wire circuits being different from one another;

wherein the first control part selectively at least controls the output ends of the first conductive part for coupling to the input ends of one of the wire circuits, or controls the input ends of the second conductive part for coupling to the output ends of the same wire circuit.

2. The audio transmission line according to claim 1, wherein the first control part shifts by a displacement corresponding to a rotary operation.

3. The audio transmission line according to claim 1, wherein the first control part shifts by a displacement corresponding to a rectilinear operation.

4. The audio transmission line according to claim 1, wherein the inline controller has a first body and a second body, the first body is used for accommodating a first switch, the wire circuits are formed on the first switch, and the second body is rotatably connected with the first body; when the second body is rotated relative to the first body, the second body links up the first control part for controlling the first conductive part and the second conductive part simultaneously to couple to one of the wire circuits.

5. The audio transmission line according to claim 1, wherein the inline controller further includes:

a second control part mechanically linking up a third conductive part and a fourth conductive part, input ends of the third conductive part is coupled to part of the output ends of the second conductive part, and output ends of the fourth conductive part is coupled to part of the signal output ends; and a second switch coupled between the third conductive part and the fourth conductive part and having a plurality of auxiliary wire circuits, wherein an predetermined auxiliary pin connection relationship is provided between input ends and output ends of each of the auxiliary wire circuits, and the predetermined auxiliary pin connection relationships of different auxiliary wire circuits are different from one another;

wherein the second control part selectively controls the output ends of the third conductive part for coupling to the input ends of one of the auxiliary wire circuits, and controls the input ends of the fourth conductive part for coupling to the output ends of the same auxiliary wire circuit.

6. The audio transmission line according to claim 5, wherein the inline controller has a first body and a second body, the first body is used for accommodating the first switch and the second switch, and the second body is rotatably connected with the first body; when the second body is rotated relative to the first body, the second body links up at least the first control part or the second control part, and at least allows the first control part to control the first conductive part and the second conductive part for simultaneously coupling to one of the wire circuits, or allows the second control part to control the third conductive part and the fourth conductive part for simultaneously coupling to one of the auxiliary wire circuits.

7. The audio transmission line according to claim 6, wherein the second body of the inline controller rotates around an extension line of a long axis of the first body.

8. A headset, comprising:

an audio transmission plug for being coupled to an electrical device, and having a plurality of signal transmission units for transmitting a plurality of headset signals, each of the signal transmission units transmitting one of the headset signals;

an inline controller coupled to the audio transmission plug through a signal cable, including:

a signal input module having a plurality of signal input ends, each of the signal input ends being coupled to one of the signal transmission units in an one-to-one fashion;

a signal output module having a plurality of signal output ends;

a first control part mechanically linking up at least a first conductive part or a second conductive part, input ends of the first conductive part being coupled to the signal inputs, and output ends of the second conductive part being coupled to the signal output ends; and a plurality of wire circuits, a predetermined pin connection relationships being provided between input ends and output ends of each of the wire circuits, and the predetermined pin connection relationships of different wire circuits being different from one another; and an audio output device coupled to the signal output module, for generating sounds corresponding to a sequence of the headset signals outputted by the signal output ends;

wherein the first control part selectively at least controls the output ends of the first conductive part for coupling to the input end of one of the wire circuits, or controls the input ends of the second conductive part for coupling to the output ends of the same wire circuit.

9. The headset according to claim 8, wherein the inline controller has a first body and a second body, the first body is used for accommodating a first switch, the wire circuits are formed on the first switch, and the second body is rotatably connected with the first body; when the second body is rotated relative to the first body, the second body links up the first control part for controlling the first conductive part and the second conductive part simultaneously to couple to one of the wire circuits.

10. The headset according to claim 8, wherein the inline controller further includes:

a second control part mechanically linking up a third conductive part and a fourth conductive part, input ends of the third conductive part is coupled to part of the output ends of the second conductive part, and output ends of the fourth conductive part is coupled to part of the signal output ends; and a second switch coupled between the third conductive part and the fourth conductive part and having a plurality of auxiliary wire circuits, wherein an predetermined auxiliary pin connection relationships is provided between input ends and output ends of each of the auxiliary wire circuits, and the predetermined auxiliary pin connection relationships of different auxiliary wire circuits are different from one another;

wherein the second control part selectively controls the output end of the third conductive part for coupling to the input ends of one of the auxiliary wire circuits, and controls the input ends of the fourth conductive part for coupling to the output ends of the same auxiliary wire circuit.

11. The headset according to claim 10, wherein the inline controller has a first body and a second body, the first body is used for accommodating the first switch and the second switch, and the second body is rotatably connected with the first body; when the second body is rotated relative to the first body, the second body links up at least the first control part or the second control part, and at least allows the first control part to control the first conductive part and the second conductive part for simultaneously coupling to one of the wire circuits, or allows the second control part to control the third conductive part and the fourth conductive part for simultaneously coupling to one of the auxiliary wire circuits.

12. The headset according to claim 11, wherein the second body of the inline controller rotates around an extension line of a long axis of the first body.

* * * * *